US008708191B2

(12) United States Patent
Rose et al.

(10) Patent No.: US 8,708,191 B2
(45) Date of Patent: Apr. 29, 2014

(54) METHOD OF MAKING AND TRANSPORTING A CONTAINER WITH A CARRYING HANDLE AND A CONTAINER WITH A CARRYING HANDLE THEREFOR

(75) Inventors: Axel Rose, Ehringen (DE); Roger Kesting, Waldeck (DE); Jörg Syring, Bad Arolsen (DE); Ludger Pauls, Ven-Zelderheide (NL)

(73) Assignee: KHS GmbH, Dortmund (DE)

( * ) Notice: Subject to any disclaimer, the term of this patent is extended or adjusted under 35 U.S.C. 154(b) by 1200 days.

(21) Appl. No.: 12/425,838

(22) Filed: Apr. 17, 2009

(65) Prior Publication Data

US 2009/0255946 A1 Oct. 15, 2009

Related U.S. Application Data

(63) Continuation-in-part of application No. PCT/EP2007/008924, filed on Oct. 15, 2007.

(30) Foreign Application Priority Data

Oct. 18, 2006 (DE) ..... 10 2006 049 147

(51) Int. Cl.

| | |
|---|---|
| ***B65D 25/28*** | (2006.01) |
| ***B65D 25/32*** | (2006.01) |
| ***B65D 5/46*** | (2006.01) |

(52) U.S. Cl.

CPC ..... *B65D 25/32* (2013.01); *B65D 5/46032* (2013.01); *B65D 2525/28* (2013.01); *B65D 25/28* (2013.01)

USPC ..... 220/757; 220/756; 220/771; 220/754; 229/117.22

(58) Field of Classification Search

USPC ..... 220/318, 212.5, 846, 710.5, 752, 753, 220/754, 755, 757, 758, 759, 760, 761, 762, 220/764, 767, 768, 769, 770, 771, 773, 774, 220/775, 776; 229/117.22

See application file for complete search history.

(56) References Cited

U.S. PATENT DOCUMENTS

| | | | | |
|---|---|---|---|---|
| 4,905,888 | A | 3/1990 | Suoss et al. | |
| 5,080,281 | A * | 1/1992 | Seabold | 229/117.22 |
| 6,220,506 | B1 * | 4/2001 | Knight | 229/117.22 |

(Continued)

FOREIGN PATENT DOCUMENTS

| | | |
|---|---|---|
| DE | 81 27 136 | 2/1982 |
| DE | 85 15 485 | 7/1985 |

(Continued)

OTHER PUBLICATIONS

International Search Report PCT/EP2007/008924 and English translation thereof.

(Continued)

*Primary Examiner* — Robert J Hicks
*Assistant Examiner* — Kareen Rush
(74) *Attorney, Agent, or Firm* — Nils H. Ljungman & Associates

(57) ABSTRACT

A method of making and transporting a container with a carrying handle and a container with a carrying handle therefor. The abstract of the disclosure is submitted herewith as required by 37 C.F.R. §1.72(b). As stated in 37 C.F.R. §1.72 (b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 3 Drawing Sheets

(56) References Cited

U.S. PATENT DOCUMENTS

| | | | | |
|---|---|---|---|---|
| 6,513,657 | B2 * | 2/2003 | Sheehan, Jr. | 206/497 |
| 2010/0089987 | A1 * | 4/2010 | Brandinelli | 229/117.22 |
| 2011/0147397 | A1 * | 6/2011 | Oster et al. | 220/754 |

FOREIGN PATENT DOCUMENTS

| | | |
|---|---|---|
| DE | 38 12 444 | 10/1989 |
| DE | 42 24 696 | 1/1994 |
| DE | 202 10 056 | 11/2002 |
| FR | 2 653 747 | 5/1991 |

OTHER PUBLICATIONS

International Preliminary Report on Patentability PCT/EP2007/008924 and English translation thereof.

* cited by examiner

METHOD OF MAKING AND TRANSPORTING A CONTAINER WITH A CARRYING HANDLE AND A CONTAINER WITH A CARRYING HANDLE THEREFOR

CONTINUING APPLICATION DATA

This application is a Continuation-In-Part application of International Patent Application No. PCT/EP2007/008924, filed on Oct. 15, 2007, which claims priority from Federal Republic of Germany Patent Application No. 10 2006 049 147.5, filed on Oct. 18, 2006. International Patent Application No. PCT/EP2007/008924 was pending as of the filing date of this application. The United States was an elected state in International Patent Application No. PCT/EP2007/008924.

BACKGROUND

1. Technical Field

The present application relates to a method of making and transporting a container with a carrying handle and a container with a carrying handle therefor.

2. Background Information

Background information is for informational purposes only, and does not necessarily admit that subsequently mentioned information and publications are prior art.

The present application relates to a carrying handle that is configured to be gripped such as for carrying of a container, for example a large-volume packaging made, for instance, from a cardboard material, from a plastic material, or from such like material, which carrying handle comprises a grip band that is configured to be shortened, before coming into use, by at least one fold structure, or fold arrangement, and the grip band is fixed in this position.

Some carrying handles are configured to be gripped such as for carrying, having simple embodiments of reasonable cost. For this purpose, a reinforcing band is glued over the respective ends of the grip band and transverse with respect to the grip band. In addition, the grip band comprises fold structures, or fold arrangements, which are held together by means of an adhesive point. To transfer accordingly, the grip band that is shortened by the fold structure, or fold arrangement, into the use position. Which may allow a pertaining loop structure that is configured to be carried. It is necessary or desired to release the pertaining adhesive connection. This can also happen unintentionally. For instance, while storing, or transporting such containers, the pertaining adhesive connection could be disrupted. This is because, the grip band offers beginning points, or surfaces, that allow for the possible release of the pertaining adhesive connection. The present application is to provide remedies.

OBJECT OR OBJECTS

An object or task of the present application is to describe the further development of a carrying handle that is configured to be gripped such as for carrying of a container of the type as described in the foregoing so that the container can be carried substantially perfectly and is not prone, for example during the transportation thereof, to damages, or that the fold structure or fold arrangement is unintentionally released, or disturbed.

SUMMARY

For the solution of this technical problem, a carrying handle of the type described herein for a container wherein there is provided a releasable portion that is configured by a tab, or flap which releasable portion is disposed so as to be positioned at least in part atop the fold structure, or fold arrangement, and which releasable portion serves for generally fixing the fold structure, or fold arrangement in its place, or in its condition.

Consequently, with the help, that is, upon removal of the releasable portion that is configured by a tab, or flap, the pertaining fold structure, or fold arrangement can be lifted, or released, or unfolded according to demand. Due to the fact, that the releasable portion that is configured by a tab, or flap extends in part over the fold structure or fold arrangement and comprises, in one possible embodiment, at least one loose end the releasable portion that is configured by a tab, or flap can be removed easily by hand from its position atop the fold structure or fold arrangement. Upon removal of the releasable portion the carrying handle that is configured to be gripped such as for carrying is taken into use, and the carrying handle is transferred by an operator into its position of use.

However, prior to coming into use the grip band lies close at the container, in one possible embodiment at the upper side of the container, and/or at the lateral sides of the container. By the fact that the grip band lies close and virtually (quasi) free of a measurable distance, or substantially directly at the pertaining surfaces of the container and simultaneously or substantially simultaneously snuggles up, as it were, to the container surfaces no attack points are provided which might transform the grip band, prior to the intentional coming into use, in an unintentional manner into the loop structure that is configured to be gripped. Thus, in one possible embodiment during the transport of the containers no damages and disturbances are to be expected, and the grip band remains undisturbed in its rest position, and furthermore, is not deformed. When the releasable portion that is configured by a tab, or flap is actively or intentionally removed by the operator the loop structure that is configured to be gripped can be given its loop-defining configuration.

The grip band is divided into an attaching portion, or region and a free portion, or region. The attaching portion, or region and the free portion, or region are connected to one another, prior to coming into use of the grip band, due to the pertaining fold structure, or fold arrangement at or on at least one end of the free portion, or region. After assuming its position, or condition of use, the free portion, or region forms, together with the material providing the fold structure, or fold arrangement, the loop structure that is configured to be gripped. As such, the free portion, or region of the grip band, before coming into use, lies closely at the container and here in one possible embodiment upon the upper side of the container, and/or at one, or at several lateral sides of the container.

In contrast, the attaching portion, or region provides for the fact that the grip band is connected substantially perfectly or securely to the container. For this, the attaching portion, or region is connected in full, or in a part in an adhesive manner to the container. Thus, the grip band comprises, in one embodiment, a central free portion, or region which central portion has—prior to coming into use—at its respective ends a pertaining fold structure, or fold arrangement and adjoining the pertaining fold structure, or fold arrangement, on each side, are the respective attaching portions, or regions. However, in another embodiment of the present application, one fold structure or fold arrangement is contemplated at one end of the free portion, or region.

Thus, the grip band can thereby be led all together from one lateral side of the container about the upper side of the container to the other lateral side of the container and in this manner surrounds the container, for instance, at a lid provided at the upper side, or terminus of the container, practically in a u-shape configuration. In accordance with one possible arrangement the free portion, or region of the grip band comprises at its two ends a respective attaching portion, or region, but, indeed, at one end of the grip band there is included the fold structure, or fold arrangement. This arrangement provides substantially the same effect, namely, that the grip band snuggles up to, as it were, or is tightly disposed—before coming into use—upon the pertaining surface of the container and forms—after coming into use—the loop structure that is configured to be gripped, namely with respect to the herein-above described arrangement (with two fold structures, or fold arrangements) but at a reduced cost. In any case, the grip band surrounds the container in u-shape manner, as it were, prior to coming into use. Thus, in this manner the most often utilized single fold structure, or fold arrangement is disposed in the region of a lateral side of the container, and the single fold structure, or fold arrangement is substantially predominantly held safely during the storage atop one container, on another container, and during transportation thereof.

The fold structure, or fold arrangement generally comprises at least two fold loop structures which are disposed to be recumbent on one another. In the case of such two loop structures there is provided, on the one hand, a fixing fold loop structure, and on the other hand, a free fold loop structure. The fixing fold loop structure is connected to the attaching portion, or region, whereas the free fold loop structure is connected to the free portion, or region. Of course, it will be understood that the two fold loop structures that are disposed to be recumbent on one another can easily glide at their adjacent surfaces along one another because in this case the two fold loop structures are not mutually fixed to one another, but rather are entirely held together in their folded position, or condition by the releasable portion that is configured by a tab, or flap. Naturally, it is also within the scope of the present application that the fixing fold loop structure and the free fold loop structure can enter into a releasable connection with respect to one another.

In one possible embodiment, the releasable portion that is configured by a tab, or flap is connected, on the one hand, to the fold structure, or fold arrangement, and here in detail, to the free fold loop structure, and on the other hand, to the packaging, or respectively, to the container, and/or to the attaching portion, or region of the grip band, or respectively, to the grip band in its entirety. In this way the releasable portion that is configured by a tab, or flap and the grip band can form a constructive unit, or respectively, a production unit. In this the fold structure, or fold arrangement will be made generally prior to, during, or after the attaching, or the attaching to the pertaining element of the releasable portion that is configured by a tab, or flap and the fold structure, or fold arrangement is then fixed, or secured. Beyond this, it is of course conceivable that the grip band is brought to the assembly operation with the fold structure, or fold arrangement and is then connected to the container, and then in conclusion is attached to the releasable portion that is configured by a tab, or flap. Naturally, one can also fix the grip band plus releasable portion that is configured by a tab, or flap together as a constructive unit to the container.

In any case, a carrying aid, or carrying handle is configured that, accordingly, is substantially flawless optically or visually and technically, and that is configured to be gripped such as for carrying, and this is placed at ones disposal in the embodiment of the grip band that is fixed—by means of the releasable portion that is configured by a tab, or flap—in the region of the fold structure, or fold arrangement. In conformity with the length of the respective free fold loop structure and the fixing fold loop structure the length of the carrying loop structure that comprises the grip band and the fold structure can be varied, and can thus be adapted to the pertaining requirements. An ergonomically possible and optically visually pleasing aid for carrying, or transporting is thereby placed at ones disposal. As well, the change from the transporting position—prior to coming into use of the grip band—to the use position, per se, and the coming into use of the grip band, is effectuated simply and rapidly because it is merely necessary or desired for this to manually remove the releasable portion that is configured by a tab, or flap from its condition of fixing the fold structure, or fold arrangement using the pertaining loose end.

In this connection, and because usually the grip band and the releasable portion that is configured by a tab, or flap are made from a strand of plastic-synthetic material, the two aforementioned elements can also be used as an advertising media, or respectively, can be provided with printing. The fold structure, or fold arrangement can be attached in each case during the production of the packaging easily in a flow-through manner and can then be fixed using the releasable portion that is configured by a tab, or flap.

As such the container may concern a cardboard container used to package a detergent, a carton to package shoes, a canister, or in general a cardboard type container, or a plastic container. Also, bundles can be equipped with the handle of the present application that is configured to be gripped such as for carrying. Because the handle that is configured to be gripped such as for carrying in accordance with the present application in one possible embodiment is placed in u-shape configuration about the container, there exists the possibility for one to work with a relatively long free fold loop structure and fixing fold loop structure, so that basically a loop structure that is configured to be gripped can be realized which may act not only as a handle that is configured to be gripped such as for carrying for the container. But a shoulder belt can be also placed at ones disposal with the help of the handle that is configured to be gripped such as for carrying in accordance with the present application. The pertaining containers can be thereby taken, after removing of the releasable portion that is configured by a tab, or flap, also from above, for instance, from a pallet, so that the possibilities of the use, the transportation and the ergonomic conveying options are clearly increased with respect to hitherto used embodiments.

To this contributes the fact that in addition the grip band and the releasable portion that is configured by a tab, or flap are configured in each case of possibly substantially the same width. Of course, the present application also applies to the embodiment wherein the releasable portion that is configured by a tab, or flap has, on the one hand, a different width than, on the other hand, the grip band. In one possible embodiment the grip band and the releasable portion that is configured by a tab, or flap run in common longitudinal extent along the packaging, namely, mostly along the lateral sides and the upper side, or surface. In conclusion, it is added that the releasable portion that is configured by a tab, or flap, and/or the grip band comprise in each case at least one adhesively active adhesive side. In this, the releasable portion that is configured by a tab, or flap may comprise from the beginning an one-sided coated adhesive tape which is devoid of an adhesive coating merely in the area of its pertaining loose end. In contrast, the adhesive for the grip band, or its attaching portion, or region is usually applied shortly prior to its fixing to the container, for example, the adhesive is applied by a spray-on type of procedure. Here liquid as well as hot-liquid pastes can find use. The object of the present application with independent importance is also a container, in one possible embodiment a large-volume packaging made from, for instance, cardboard, plastic, or such like materials which is equipped with a handle that is configured to be gripped such as for carrying of the construction as described in the foregoing description.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

In the following the present application is explained with reference to the accompanying drawings, which without being limited thereto, merely explain an embodiment of the present application, wherein is shown in.

DESCRIPTION OF EMBODIMENT OR EMBODIMENTS

Figure 1B:
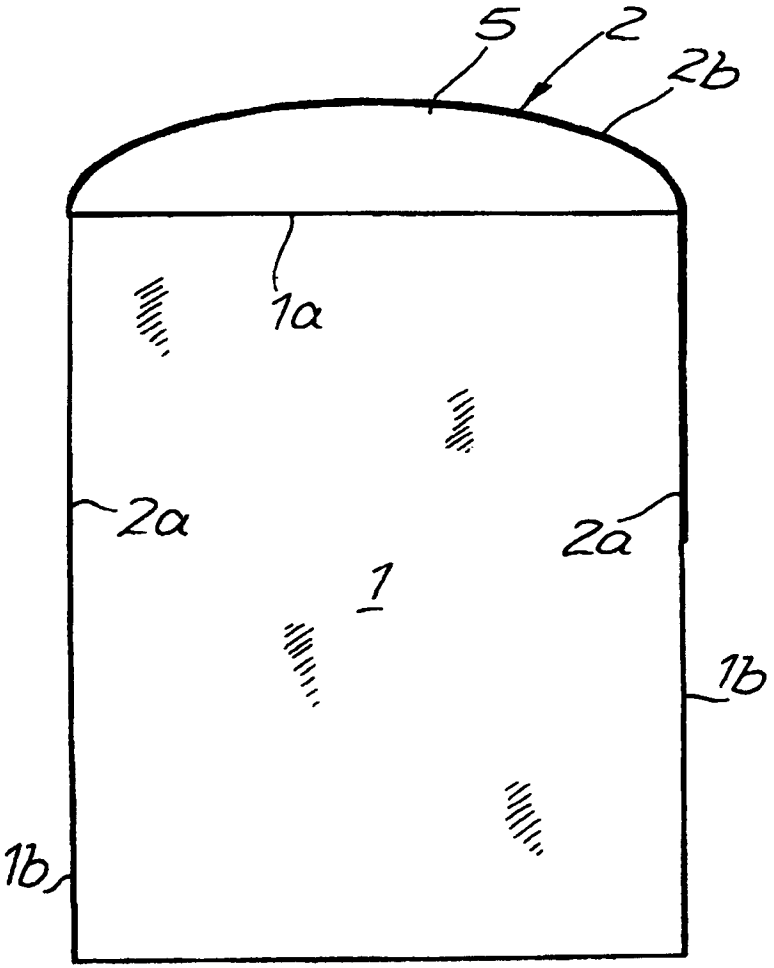
FIG. 1*b* shows the container according to the present application including a handle configured to be gripped for carrying, after coming into use.
Figure 1A:
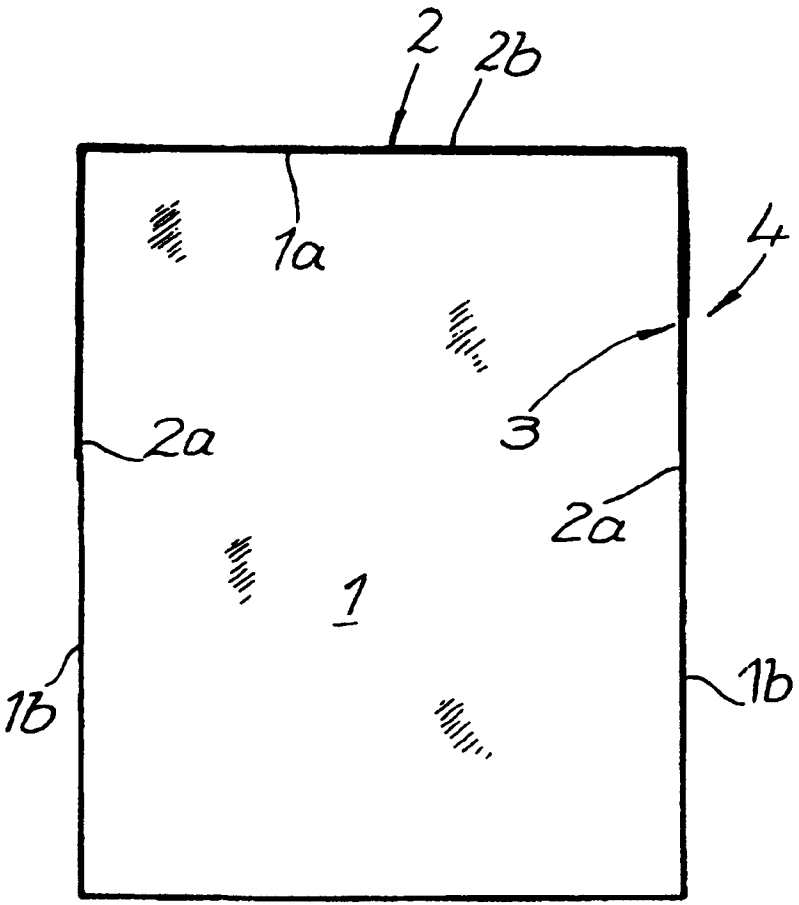
FIG. 1*a* shows the container according to the present application including a handle configured to be gripped for carrying, before coming into use.

In the FIGS. 1*a* and 1*b*, a container 1 is shown which, not limited thereto, comprises a large-volume, rectangular packaging made from a cardboard material. As such, the container 1 may be one that is configured as a cardboard detergent container, but this is not to be understood as required or desired, or limiting the present application thereto. The container 1 in question is equipped with a grip band 2.

In one possible embodiment, the container 1 could comprise various dimensions and weights. Examples could include packaging dimensions of 11.5 inches by 12.5 inches by 5.5 inches and a weight of twenty-two pounds, 10.1 inches by 10 inches by 4.6 inches and weight of one pound, or 11.11 inches by 11.6 inches by 6.42 inches and weight of 18.2 pounds. The container dimensions are not limited to these examples, and could vary in other dimensions, weights, and/or sizes.

Prior to coming into use the grip band 2 and during the transporting thereof, grip band 2 is disposed tight and without a gap at the pertaining wall, or side of the container 1, as is evident from a perusal of FIG. 1*a*. Here one recognizes that the grip band 2 is respectively connected to a side 1*b* of the container 1 and is led for its remainder from the right side 1*b*, about upper side 1*a*, to the left side 1*b*. The grip band 2 surrounds the pertaining container 1 prior to being put into use, for example, substantially in u-shape configuration, or arrangement.

In other words, in FIG. 1*a* the grip band 2 is disposed tight, and without a gap, against the side of container 1. The grip band 2 is connected to the sides 1*b* of the container. The grip band is led from the right connection at side 1*b* about the upper side 1*a* to the connection at the left connection at side 1*b*. Prior to use, the grip band is in a u-shape or substantial u-shape configuration or arrangement.

In the transportation position, and before coming into use, the grip band 2 is shortened by the fold arrangement 3. The grip band 2 is also fixed in this shortened position. For the fixing, or securing of the fold arrangement 3, a releasable portion 4 is realized within the scope of the present application. The releasable portion 4 could be configured by a tab, or flap. One can recognize clearly in the detail view of FIG. 2, the fold arrangement 3 secured by the releasable portion 4. So as to fix the fold arrangement 3, the releasable portion 4 extends, at least in part, over the pertaining fold arrangement 3.

As already explained, before coming into use, the grip band 2 lies closely, or tightly against the container 1, or the two lateral sides 1*b* thereof and against the upper side 1*a* of the container and forms, after its coming into use. In other words, the grip band 2 lies closely or tightly against the container prior to use. By removing the releasable portion 4, the loop structure 5, which is configured to be gripped, comes into use, as seen in FIG. 1*b*. The greater length, when compared to the grip band 2 in the condition prior to coming into use of the loop structure 5, that is configured to be gripped in the use position, is due to the pertaining fold arrangement 3. Fold arrangement 3 is brought to the unfolded condition for attainment of the use condition by removing the releasable portion 4. In other words, fold arrangement 3 holds the slack of the grip band closely or tightly against the container. By removing the releasable portion 4, the grip band forms the loop structure 5 of FIG. 1*b*. The loop structure 5 is the use condition, or carrying position of the grip band 2.

The grip band 2 is divided into at least at one attaching portion, or region 2*a* and a free portion, or region 2*b*. With the help of a comparative consideration of FIGS. 1*a*, FIG. 1*b* and FIG. 2 one recognizes that the grip band 2 comprises two attaching portions 2*a*, that are secured to the lateral sides 1*b* of the container 1, as well as one free portion 2*b* that is disposed between the attaching portions 2*a*. In this configuration, in the embodiment example, the fold arrangement 3 is contemplated at one end of the free portion 2*b*, namely, at the right end, and connects, accordingly, the relevant right end of the free portion 2*b* to the attaching portion 2*a*.

Actually one fold arrangement 3 is realized in the course of the grip band 2, namely at an end of its free portion 2*b*, and this is due to considerations of cost. Of course, both ends of the free portion 2*b* can also merge in each case into a fold arrangement 3 with in each case the attaching portion 2*a* being contiguously connected thereto. However, such an arrangement, or embodiment is mostly avoided, restricted, and/or minimized.

The attaching portion 2*a* of the grip band 2 is fully connected, or in part connected to the container 1, namely, to the respective lateral sides 1*b* as is shown in the embodiment example. For this purpose a liquid, respectively, a hot-liquid adhesive, may be sprayed onto grip band 2, prior to its affixing to the container 1, or may be sprayed onto the pertaining lateral side surfaces 1*b*. In contrast, the outwardly directed surface of the grip band 2 is free, or respectively, at most comprises a protective layer, or may show an advertising print. The same applies to releasable portion 4, which may be equipped on its outwardly directed surface likewise with a printing, but in any case here does not carry an adhesive coating. This is achieved in simple manner since grip band 2 as well as releasable portion 4 basically comprise in each case plastic-synthetic strands of rectangular cross-section, and can basically in each case be produced as a plastic strip comprising, for instance, polyethylene or polypropylene.

Figure 2:
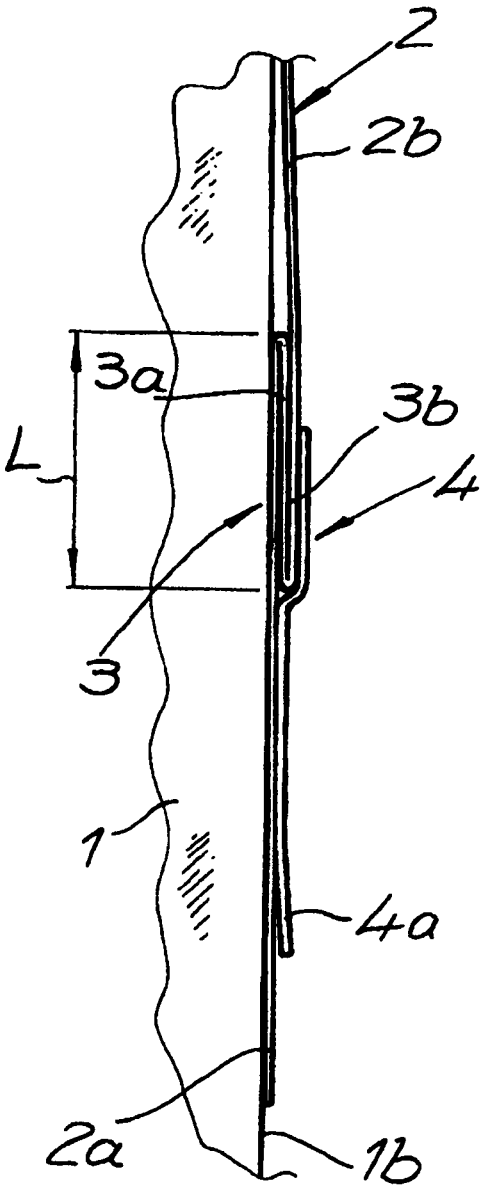
FIG. 2 illustrates the grip band folding and fold arrangement in a detail view.

With the help of the detailed view in FIG. 2, one recognizes that the fold arrangement 3 comprises at least two fold loop structures 3*a*, 3*b* that are disposed in recumbent manner with respect to one another. As such, there is a provided fixing fold loop structure 3*a* that is contiguously connected to the attaching portion 2*a* as well as a free fold loop structure 3*b* that is contiguously connected to the free portion 2*b*. The two fold loop structures 3*a*, 3*b* extend by a length L atop, or in substantially congruent manner with respect to one another, with the length 2×L comprising the extent of lengthening of the grip band 2 on merging from the transporting position, or condition that is illustrated in FIG. 1*a*, into the position, or condition of use as is illustrated in FIG. 1*b*. Both fold loop structures 3*a*, 3*b* can be connected to one another at their inner surfaces that are facing one another in a releasable manner.

Under usual circumstances the releasable portion 4 and that is fixing fold arrangement 3 is usually sufficient to essentially ensure or promote that fold arrangement 3 is not unintentionally unfolded, and respectively the grip band 2 does not unintentionally form the loop structure 5 which is configured to be gripped. For this purpose, the releasable portion 4 extends at least partially over the free fold loop structure 3*b*, and is, accordingly, connected, on the one hand, to fold arrangement 3 and here is connected to the free fold loop structure 3*b*. On the other hand, there is a connection between the releasable portion 4 that is configured by a tab, or flap and the container 1. Conversely, in detail, the releasable portion 4 that is configured by a tab, or flap is connected to the attaching portion, or region 2*a* of the grip band 2. For this purpose, the releasable portion 4 that is configured by a tab, or flap may be configured as an adhesive tape with an one-sided adhesive coating on that side that is turned towards the grip band 2 as well as the fold structure, or fold arrangement 3. Nevertheless, on this occasion, a loose end 4*a* of the releasable portion 4 that is configured by a tab, or flap is excluded and this shows consistently or substantially consistently no adhesive coating. The loose end 4*a* serves for the manual removal of the releasable portion 4 that is configured by a tab, or flap from the fold structure, or fold arrangement 3 upon the grip band 2 coming into use.

Figure 2A:
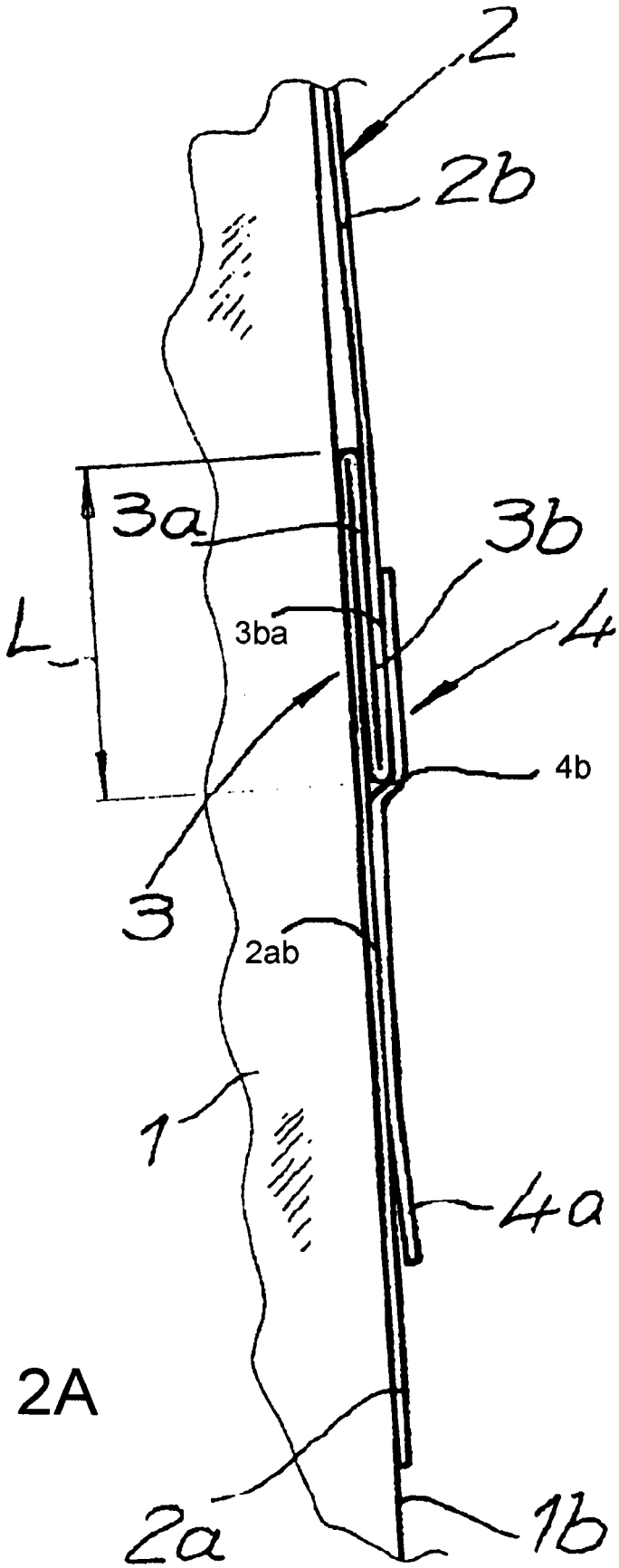
FIG. 2A displays one possible embodiment with the grip band and fold arrangement in conjunction with a hook-and-loop fastener.

In another possible embodiment the releasable portion 4 may be configured as a hook-and-loop fastener, commercially known as Velcro. To illustrate this example, FIG. 2A provides a detailed view of this possible embodiment. For example, a loop tape strip 3*ba* may be placed on fold loop structure 3*b*. The loop side is turned towards the releasable portion 4. An interlock-able hook tape strip 4*b* could be placed on the releasable portion 4, which faces the loop tape strip 3*ba* on free fold loop structure 3*b*. The loop tape strip 3*ba* located on free fold structure 3*b*, could have a length equal or substantially equal to the contact surface area of releasable portion 4. A loop tape strip 2*ab* may be disposed on the attaching portion 2*a* with the loop side turned towards the releasable portion 4. The hook tape strip 4*b* could comprise a length equal to the corresponding loop tape strip 3*ba* located on the free fold loop structure 3*b*, and additional length of the loop tape strip 2*ab* located on attaching portion 2*a*. However, the loose end 4*a* does not usually comprise hooking tape 4*b*, and therefore is free from attaching with loop tape strip 2*ab* . The loose end 4*a* serves for the manual removal of the releasable portion 4 from the free fold structure 3 upon the grip band 2 coming into use.

The grip band 2 and the releasable portion 4 that is configured by a tab, or flap can respectively comprise a substantially identical width. In addition, in one possible embodiment the grip band 2 and the releasable portion 4 that is configured by a tab, or flap are arranged in a common longitudinal extent along the packaging 1, or respectively, run in a common longitudinal extent. On the basis of FIG. 2 it will be clear that the attaching portion, or region 2*a* of the grip band 2, due to its length, reaches beyond the releasable portion 4 that is configured by a tab, or flap and its loose ends 4*a* when considered in the longitudinal extent. However, it is also possible that the loose end 4*a* of the releasable portion 4 that is configured by a tab, or flap and the end of the attaching portion, or region 2*a* of the grip band 2 are positioned so as to be substantially coincidentally arranged, or the end of the attaching portion, or region 2*a* is covered by the releasable portion 4 that is configured by a tab, or flap.

In at least one possible embodiment according to the present application, the fold arrangement 3 could be assembled with a releasable portion that is configured by the releasable portion 4, prior to the attaching portion 2*a* of grip band 2 being affixed to a lateral side of container 1*b*. For example, the grip band is folded, and the fold is held in place by the releasable portion 4. The folded grip band 2 is then attached to the container 1.

In another possible embodiment of the present application, the grip band 2 may be assembled without a releasable portion 4. The fold structure 3 could be fixed to the attaching portion 2*a* by means of an adhesive, or a hook-and-loop fastener, such as Velcro. Part of the fold structure 3 may comprise a free region to provide a user a loose end, for the manual removal of the free fold structure 3 from the attaching porting 2*a*.

The subject of the present application is a carrying handle that is configured to be gripped such as for carrying of a container 1, in one possible embodiment a large-volume packaging 1 made from, for instance, a cardboard material, from a plastic material, or from such like material. The carrying handle that is configured to be gripped such as for carrying comprises a grip band 2 that is, prior to coming into use, shortened by at least one fold structure or fold arrangement 3 and the grip band 2 in this position is attached, or fixed in this shortened position, or condition. In accordance with the present application, there is realized a releasable portion 4 that is configured by a tab, or flap that is disposed so as to be positioned at least in part atop the at least one fold structure or fold arrangement 3 and which releasable portion 4 serves for generally fixing the at least one fold structure, or fold arrangement 3 in its place, or in its condition.

One feature or aspect of an embodiment is believed at the time of the filing of this patent application to possibly reside broadly in a carrying handle that is configured to be gripped such as for carrying of a container 1, in one possible embodiment a large-volume packaging 1 made from, for instance, a cardboard material, from a plastic material, or from such like material, with at least one grip band 2 that is, prior to coming into use, shortened by at least one fold structure, or fold arrangement 3 and that in this position the at least one grip band 2 is attached, or fixed, wherein there is provided a releasable portion 4 that is configured by a tab, or flap that is disposed so as to be positioned at least in part atop the fold structure or fold arrangement 3, and which portion 4 serves for generally fixing the fold structure or fold arrangement 3 in its place, or in its condition.

Another feature or aspect of an embodiment is believed at the time of the filing of this patent application to possibly reside broadly in the carrying handle that is configured to be gripped such as for carrying, wherein the grip band 2 is positioned, prior to coming into use, at the container 1 and forms, after coming into use, by removing the releasable portion 4 that is configured by a tab, or flap a carrying loop structure 5 that is configured to be gripped for carrying.

Yet another feature or aspect of an embodiment is believed at the time of the filing of this patent application to possibly reside broadly in the carrying handle that is configured to be gripped such as for carrying in accordance, wherein the grip band 2 is divided into an attaching portion, or region 2*a* and into a free portion, or region 2*b*.

Still another feature or aspect of an embodiment is believed at the time of the filing of this patent application to possibly reside broadly in the carrying handle that is configured to be gripped such as for carrying, wherein the attaching portion, or region 2*a* is connected in full, or in part to the container 1 and the free portion, or region 2*b*, prior to coming into use, is in contact at the container 1 and forms, upon coming into use, together with the fold structure or fold arrangement 3 the carrying loop structure 5 that is that is configured to be gripped for carrying.

A further feature or aspect of an embodiment is believed at the time of the filing of this patent application to possibly reside broadly in the carrying handle that is configured to be gripped such as for carrying, wherein the fold structure or fold arrangement 3 comprises at least two fold loop structures 3*a*, 3*b* that are positioned to be recumbent on one another, namely one fixing fold loop structure 3*a* that is adjacent to, or connected to, the attaching portion, or region 2*a* and, furthermore, one free fold loop structure 3*b* that is linked, or connected to the free portion, or region 2*b*.

Another feature or aspect of an embodiment is believed at the time of the filing of this patent application to possibly reside broadly in the carrying handle that is configured to be gripped such as for carrying, wherein the releasable portion 4 that is configured by a tab, or flap comprises at least one loose end, or release portion, or release tab 4*a* that is positioned in such a way that, upon coming into use, it can be removed from the fold structure or fold arrangement 3.

Yet another feature or aspect of an embodiment is believed at the time of the filing of this patent application to possibly reside broadly in the carrying handle that is configured to be gripped such as for carrying, wherein the releasable portion 4 that is configured by a tab, or flap is connected on the one hand to the fold structure or fold arrangement 3 and, on the other hand, to the container 1, and/or to the grip band 2.

Still another feature or aspect of an embodiment is believed at the time of the filing of this patent application to possibly reside broadly in the carrying handle that is configured to be gripped such as for carrying, wherein the grip band 2 and the releasable portion 4 that is configured by a tab, or flap comprise substantially the same width and extend in common longitudinal extent along the container 1.

A further feature or aspect of an embodiment is believed at the time of the filing of this patent application to possibly reside broadly in the carrying handle that is configured to be gripped such as for carrying, wherein the releasable portion 4 that is configured by a tab, or flap, and/or the grip band 2, respectively comprise at least one adhesively active adhesive side.

Yet another feature or aspect of an embodiment is believed at the time of the filing of this patent application to possibly reside broadly in a container 1, in one possible embodiment large-volume packaging 1 made from, for instance, a cardboard material, a plastic material, or such like material, comprising a carrying handle that is configured to be gripped such as for carrying in accordance with the present application.

One feature or aspect of an embodiment is believed at the time of the filing of this patent application to possibly reside broadly in a method of making, transporting and using contents of a filled rectangular parallelepiped container, which filled rectangular parallelepiped container comprises a carrying handle of a sufficient length, which sufficient length allows a user to comfortably carry and use said filled rectangular parallelepiped container with said carrying handle; said method comprising the steps of: filling a rectangular parallelepiped container with a material; closing said rectangular parallelepiped container; securing the closure of said rectangular parallelepiped container; cutting a strip of material in order to form a carrying handle with a predetermined length and predetermined slack, in use, of said rectangular parallelepiped container; folding a portion of said strip of material to remove the predetermined slack prior to forming said carrying handle on said rectangular parallelepiped container; fastening said folded portion with a releasable, adhesive strip over said folded portion, said releasable, adhesive strip comprising an adhesive portion and non-adhesive portion; attaching a first end of said strip of material to a first vertical side, in use, of said rectangular parallelepiped container; attaching a second end of said strip of material to a second vertical side, in use, of said rectangular parallelepiped container, and producing a carrying handle without slack; shipping said rectangular parallelepiped container to a store; purchasing said rectangular parallelepiped container by said user; gripping and pulling said non-adhesive portion of said releasable, adhesive strip fastened over said folded portion; releasing said folded portion of said carrying handle; extending said carrying handle to provide a sufficient gripping area for a user; and carrying said rectangular parallelepiped container by said extended carrying handle.

Another feature or aspect of an embodiment is believed at the time of the filing of this patent application to possibly reside broadly in the product obtained by the process, a method of making a rectangular parallelepiped container, which rectangular parallelepiped container comprises a handle of a sufficient length, which sufficient length allows a user to transport said rectangular parallelepiped container with said handle.

Yet another feature or aspect of an embodiment is believed at the time of the filing of this patent application to possibly reside broadly in the method, wherein: said folded portion is configured to be disposed on at least one of: said first end of said strip of material; and said second end of said strip of material; said folded portion comprises a free loop structure, which free loop structure is fastened on at least one of: said first end of said strip of material; and said second end of said strip of material; said free loop structure comprises said sufficient portion of said predetermined slack; said folded portion further comprises a fixing loop structure, which fixing loop structure is connected to at least one of: said first end of said strip of material; and said second end of said strip of material; said fixing loop structure is adjacent or connected to said free loop structure; said non-adhesive tab is configured to be disposed on at least one of: said rectangular parallelepiped container; and said strip of material; said strip of material further comprises substantially the same width as said releasable, adhesive portion; said strip of material is further configured to extend along a predetermined length along said rectangular parallelepiped container; said releasable, adhesive portion is further configured to extend along a portion of said predetermined length of said strip of material and along said rectangular parallelepiped container; at least one of (a) and (b): (a) said releasable, adhesive portion further comprises an adhesive side in contact with said strip of material; and (b) said strip of material further comprises an adhesive side in contact with said releasable, adhesive portion; said handle is configured to be gripped for carrying; said first end of said strip of material and said second end of said strip of material are substantially attached to said rectangular parallelepiped container; substantially all portions of said strip of material, except for said folded portion of said strip of material, prior to said step of removing said releasable, adhesive strip, are in contact with said rectangular parallelepiped container; said rectangular parallelepiped container comprises a large volume-packaging; and said rectangular parallelepiped container further comprises cardboard, plastic, or like material.

Still another feature or aspect of an embodiment is believed at the time of the filing of this patent application to possibly reside broadly in a method of making a container, which container comprises a handle of a sufficient length, which sufficient length allows a user to transport said container with said handle; said method comprising the steps of: providing a pre-handle with a predetermined length and with a predetermined slack in said handle to provide a sufficient length to allow a user to transport said container with said handle; folding a portion of said pre-handle to provide a folded portion to take up a sufficient portion of said predetermined slack while permitting attachment to a container; attaching a first end of said pre-handle to a first portion of said container; attaching a second end of said pre-handle to a second portion of said container; and fastening said folded portion to said container, releasably, and holding said folded portion of said pre-handle folded portion to said container.

A further feature or aspect of an embodiment is believed at the time of the filing of this patent application to possibly reside broadly in the means for performing the method of making a container, which container comprises a handle of a sufficient length, which sufficient length allows a user to transport the container with the handle, said means comprising: means for providing a pre-handle with a predetermined length and with a predetermined slack in a handle to provide a sufficient length to allow a user to transport a container with the handle; means for folding a portion of a pre-handle to provide a folded portion to take up a sufficient portion of said predetermined slack while permitting attachment to a container; means for attaching a first end of a pre-handle to a first portion of a container; means for attaching a second end of a pre-handle to a second portion of said container; and means for fastening a folded portion to a container, releasably, and holding the folded portion of a pre-handle folded portion to a container.

Another feature or aspect of an embodiment is believed at the time of the filing of this patent application to possibly reside broadly in an arrangement for performing the method of making a container, which container comprises a handle of a sufficient length, which sufficient length allows a user to transport the container with a handle, said arrangement comprising: a providing arrangement being configured to provide a pre-handle with a predetermined length and with a predetermined slack to provide a sufficient length to allow a user to transport a container with a handle; a folding arrangement being configured to provide a folded portion for a pre-handle to take up a sufficient portion of a predetermined slack while permitting attachment to a container; a first attaching arrangement being configured to attach a first end of a pre-handle to a first portion of a container; a second attaching arrangement being configured to attach a second end of a pre-handle to a second portion of a container; a fastening arrangement being configured to fasten a folded portion to a container, releasably, and holding a folded portion of a pre-handle folded portion to a container.

Yet another feature or aspect of an embodiment is believed at the time of the filing of this patent application to possibly reside broadly in the product obtained by the process, a method of making a container, which container comprises a handle of a sufficient length, which sufficient length allows a user to transport said container with said handle.

Still another feature or aspect of an embodiment is believed at the time of the filing of this patent application to possibly reside broadly in the method, wherein said method further comprises: filling said container with a material; closing said filled container; sealing said filled container; cutting a strip of material to provide said pre-handle with said predetermined length and said predetermined slack in said handle to provide said sufficient length to allow said user to transport said container with said handle.

A further feature or aspect of an embodiment is believed at the time of the filing of this patent application to possibly reside broadly in the method including a releasable, adhesive strip, wherein: said step of folding a portion of said pre-handle further comprises fastening said folded portion with said releasable, adhesive strip; and said method further comprises: removing said releasable, adhesive strip; and extending said pre-handle to provide a sufficient gripping area for said user.

Another feature or aspect of an embodiment is believed at the time of the filing of this patent application to possibly reside broadly in the method, wherein: said pre-handle comprises a first attached portion and a second attached portion; said step of attaching said first end of said pre-handle to said first portion of said container further comprises producing said first attached portion, which first attached portion comprises said first end of said pre-handle and said first portion of said container; said step of attaching said second end of said pre-handle to said second portion further comprises producing said second attached portion, which second attached portion comprises said second end of said pre-handle and said second portion of said container; said folded portion is configured to be disposed on at least one of: said first attached portion; and said second attached portion.

Yet another feature or aspect of an embodiment is believed at the time of the filing of this patent application to possibly reside broadly in the method, wherein: said folded portion comprises a free loop structure, which free loop structure is fastened on at least one of: said first attached portion; and said second attached portion; said free loop structure comprises said sufficient portion of said predetermined slack; said folded portion further comprises a fixing loop structure, which fixing loop structure is connected to at least one of: said first attached portion; and said second attaching portion; said fixing loop structure is adjacent or connected to said free loop structure; said releasable, adhesive strip comprises a non-adhesive tab; said step of removing said releasable, adhesive strip from said fold arrangement further comprises gripping and pulling said non-adhesive tab; and said method further comprises releasing said handle.

A further feature or aspect of an embodiment is believed at the time of the filing of this patent application to possibly reside broadly in the method, wherein: said non-adhesive tab is configured to be disposed on at least one of: said container; and said pre-handle; said pre-handle further comprises substantially the same width as said releasable, adhesive portion; said pre-handle is further configured to extend along a predetermined length along said container; and said releasable, adhesive portion is further configured to extend along a portion of said predetermined length of said pre-handle and along said container.

One feature or aspect of an embodiment is believed at the time of the filing of this patent application to possibly reside broadly in the method, wherein: at least one of (a) and (b): (a) said releasable, adhesive portion further comprises an adhesive side in contact with said pre-handle; and (b) said pre-handle further comprises an adhesive side in contact with said releasable, adhesive portion; said handle is configured to be gripped for carrying; said method further comprises forming said handle with a sufficient length to allow said user to transport said container; said first end of said pre-handle and said second end of said pre-handle are substantially attached to said container; substantially all portions of said pre-handle, except for said folded portion of said pre-handle, prior to said step of removing said releasable, adhesive strip, are in contact with said container; said container comprises a large volume-packaging; and said container further comprises cardboard, plastic, or like material.

Another feature or aspect of an embodiment is believed at the time of the filing of this patent application to possibly reside broadly in the product obtained by the process, a method of making a container, which container comprises a handle of a sufficient length, which sufficient length allows a user to transport said container with said handle.

Yet another feature or aspect of an embodiment is believed at the time of the filing of this patent application to possibly reside broadly in a container comprising: a container body and a pre-handle attached to said container body; said pre-handle having a predetermined length and with a predetermined slack; said pre-handle comprising: a folded portion being configured to take up a sufficient portion of said predetermined slack while permitting attachment to a container; a first end being attached to and disposed on a first portion of said container body; a second end being attached to and disposed on a second portion of said container body; a releasable portion comprising a tab or flap; and said releasable portion being configured and disposed to retain said predetermined slack of said folded portion in a folded condition.

Still another feature or aspect of an embodiment is believed at the time of the filing of this patent application to possibly reside broadly in the container, wherein: said releasable portion is configured to be at least partially removed from said folded portion to permit unfolding of said folded portion; and said folded portion of said pre-handle is configured, upon removal of said releasable portion, to be unfolded to permit said pre-handle to form a handle of a sufficient length to allow a user to grip said handle and transport said container.

A further feature or aspect of an embodiment is believed at the time of the filing of this patent application to possibly reside broadly in the container, wherein: said folded portion is configured to be disposed on at least one of: said first attached pre-handle end disposed on said first portion of said container body; and said second attached pre-handle end disposed on said second portion of said container body.

Another feature or aspect of an embodiment is believed at the time of the filing of this patent application to possibly reside broadly in the container, wherein at least one of (a) and (b): (a) said releasable portion comprises an adhesive side in contact with said pre-handle; and (b) said pre-handle comprises an adhesive side in contact with said releasable portion.

Yet another feature or aspect of an embodiment is believed at the time of the filing of this patent application to possibly reside broadly in the method, wherein: said first end of said pre-handle and said second end of said pre-handle are substantially attached to said container; and substantially all portions of said pre-handle, except for said folded portion of said pre-handle, prior to said step of removing said releasable, adhesive strip, are in contact with said container.

Still another feature or aspect of an embodiment is believed at the time of the filing of this patent application to possibly reside broadly in the method, wherein: said container comprises a large volume-packaging; and said container further comprises cardboard, plastic, or like material.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner, and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner, and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

One example of a machine that attaches handles to containers which may possibly may be utilized or adapted for use in at least on possible embodiment according to the present application may possibly found in the following U.S. Pat. No. 6,901,720, having the title "BEVERAGE BOTTLING PLANT FOR FILLING BOTTLES WITH A LIQUID BEVERAGE FILLING MATERIAL, AND APPARATUS FOR ATTACHING CARRYING GRIPS TO CONTAINERS WITH FILLED BOTTLES" issued on Jun. 7, 2005.

All of the patents, patent applications or patent publications, which were cited in the International Search Report dated Feb. 20, 2008, and/or cited elsewhere are hereby incorporated by reference as if set forth in their entirety herein as follows: DE 202 10 056, having the following German title "HANDHALTER ALS AUSGIESSHILFE FÜR TETRA-PACK ODER ANDERE KARTONÄHNLICHE VERPACKUNGEN ALLER GRÖBSSEN DIREKT IN ODER AN DIE VERPACKUNG INTEGRIERT ODER DARAN BEFESTIGT," published on Nov. 21, 2002; DE 42 24 696, having the following English translation of the German title "PACKING CONTAINER AND MACHINE FOR FIXING CARRYING HANDLE—USES WIDER REINFORCEMENT TABS AT HANDLE ENDS WITH Z=SHAPED FOLD INITIALLY HOLDING HANDLE FLAT AGAINST BOX," published on Jan. 27, 1994; and DE 85 15 485, having the following German title "TRAGEGRIFF FÜR EINE GROBVOLUMIGE VERPACKUNG," published on Sep. 11, 1985.

All of the patents, patent applications or patent publications, which were cited in the German Office Action dated Jan. 8, 2007, and/or cited elsewhere are hereby incorporated by reference as if set forth in their entirety herein as follows: DE 38 12 444, having the following English translation of the German title "PROCESS FOR PROVIDING PACKAGES WITH A HANDLE," published Oct. 26, 1989; DE 81 27 136, having the following German title "VERPACKUNGS-ZUSCHNITT MIT EINEM TRAGEGRIFF," published Feb. 4, 1982; and FR 2,653,747, having the following English translation of the French title "PACKAGE WITH STRAP FORMING A HANDLE, MADE FROM CARDBOARD, CORRUGATED CARDBOARD OR OTHER SHEET MATERIAL SUITABLY CUT OUT AND FOLDED, AND CORRESPONDING BLANK," published May 3, 1991.

The patents, patent applications, and patent publication listed above in the preceding three paragraphs, beginning with the phrase: "One example of a machine . . . " and ending with the phrase: ". . . published May 3, 1991," are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 049 147.5, filed on Oct. 18, 2006, having inventors Axel ROSE, Roger KESTING, Jörg SYRING, and Ludger PAULS, and DE-OS 10 2006 049 147.5 and DE-PS 10 2006 049 147.5, and International Application No. PCT/EP2007/008924, filed on Oct. 15, 2007, having WIPO Publication No. WO 2008/046571 and inventors Axel ROSE, Roger KESTING, Jörg SYRING, and Ludger PAULS, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/008924 and German Patent Application 10 2006 049 147.5 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/008924 and DE 10 2006 049 147.5 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Container, for example a large-volume packaging
1*a* Top, or upper side of container
1*b* Lateral side of container
2Grip band
2*a* Attaching portion, or region
2*b* Free portion, or region
3 At least one fold structure, or fold arrangement
3*a* Fixing fold loop structure
3*b* Free fold loop structure
4 Releasable portion that is configured by a tab, or flap
4*a* Loose end of releasable portion
5 Carrying loop structure that is that is configured to be gripped for carrying

What is claimed is:

1. A container comprising:
a container body and a grip band connected thereto;
said grip band being disposed to at least partially cover at least one exterior surface of said container body;
said grip band comprising a folded portion;
a releasable structure disposed to at least partially cover said folded portion to retain said folded portion in a folded condition prior to use of said grip band; and
said folded portion is disposed between said releasable structure and said at least one exterior surface.

2. The container according to claim 1, wherein said releasable structure comprises a tab which is at least partially removable to permit unfolding of said folded portion and formation of a carrying loop out of said grip band.

3. The container according to claim 2, wherein said grip band comprises first and second attaching portions and a free portion disposed between said attaching portions.

4. The container according to claim 3, wherein:
said attaching portions are connected to exterior surfaces of said container body;
said free portion is in contact with an exterior surface of said container body; and
upon unfolding, said folded portion and said free portion together form a carrying handle loop.

5. The container according to claim 4, wherein:
said folded portion is disposed at said first attaching portion, and comprises a first layer, a second layer, and at least one third layer connecting said first and second layers;
said first layer is connected to said first attaching portion; and
said second layer is connected to said free portion.

6. The container according to claim 5, wherein said releasable structure comprises at least one loose end that projects away from and is not in contact with said container body and/or said grip band, and is configured to be gripped by a user to initiate at least partial removal of said releasable structure.

7. The container according to claim 6, wherein said releasable structure is connected to said folded portion and at least one of: said container body and said first attaching portion.

8. The container according to claim 7, wherein said releasable structure and said grip band have substantially similar width and are elongated in a substantially similar direction.

9. The container according to claim 8, wherein:
said releasable structure comprises at least one adhesive side;
said container comprises a large volume-package; and
said container comprises cardboard or plastic.

10. The container according to claim 4, wherein:
said folded portion comprises a first folded portion;
said grip band comprises a second folded portion;
said first folded portion is disposed at said first attaching portion, and said second folded portion is disposed at said second attaching portion;
each folded portion comprises a first layer, a second layer, and at least one third layer connecting said first and second layers;
said first layer of each folded portion is connected to its corresponding attaching portion; and
said second layer of each folded portion is connected to said free portion.

11. The container according to claim 10, wherein said container comprises an additional releasable structure disposed to at least partially cover said second folded portion to retain said second folded portion in a folded condition, between said additional releasable structure and said at least one exterior surface, prior to use of said grip band, and wherein each of said releasable structures comprises a tab.

12. The container according to claim 1, wherein said folded portion is the sole folded portion of said grip band.

13. The container according to claim 1, wherein:
said grip portion has a predetermined length and a predetermined slack; and said folded portion is configured to take up a sufficient portion of said predetermined slack such that substantially the entirety of said grip portion is in contact with said at least one exterior surface of said container prior to use of said grip portion in carrying of said container body.

14. The container according to claim 1, wherein said releasable structure comprises a tab which covers said grip band in its entirety.

15. The container according to claim 1, wherein said releasable structure comprises at least one loose end that projects away from and is not in contact with said container body and/or said grip band, and is configured to be gripped by a user to initiate at least partial removal of said releasable structure.

16. The container according to claim 15, wherein said releasable structure comprises an adhesive on one side thereof to adhere said releasable structure to said folded portion and at least one of: said container body and an unfolded portion of said grip band, and said at least one loose end is free of said adhesive.

17. The container according to claim 1, wherein said releasable structure is configured to be completely removed and disconnected from the container and said grip band.

18. The container according to claim 1, wherein said grip band is configured to be held by a user to support the container body, and said releasable structure comprises a non-supporting structure, upon unfolding of said folded portion and formation of a carrying loop out of said grip band.

19. The container according to claim 1, wherein the entirety of said grip band is disposed on said at least one exterior surface of the container.

20. The container according to claim 19, wherein:

said container body comprises an outer top surface and first and second outer side surface portions; and said grip band comprises:

a first attaching portion attached to said first outer side surface portion;

a second attaching portion attached to said second outer side surface portion; and a free portion disposed between said attaching portions, and stretching across and adjacent said outer top surface, but not attached to said top surface.

* * * * *